US007269370B2

(12) United States Patent
Toyoda et al.

(10) Patent No.: US 7,269,370 B2
(45) Date of Patent: Sep. 11, 2007

(54) IMAGE FORMING DEVICE AND ITS CONTROL METHOD WITH ADJUSTMENT MODE

(75) Inventors: Akihito Toyoda, Kanagawa (JP); Yukiko Kikuchi, Kanagawa (JP); Yoshihiro Sekine, Kanagawa (JP); Masaki Kuroda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 269 days.

(21) Appl. No.: 11/060,733

(22) Filed: Feb. 18, 2005

(65) Prior Publication Data

US 2006/0067722 A1 Mar. 30, 2006

(30) Foreign Application Priority Data

Sep. 24, 2004 (JP) ..... 2004-278108

(51) Int. Cl.
*G03G 15/00* (2006.01)

(52) U.S. Cl. ..... 399/80

(58) Field of Classification Search ..... 399/80, 399/85, 87

See application file for complete search history.

(56) References Cited

U.S. PATENT DOCUMENTS 4,952,975 A * 8/1990 Ito et al.
5,459,554 A * 10/1995 Shiraishi ..... 399/87

* cited by examiner

*Primary Examiner*—Susan Lee
(74) *Attorney, Agent, or Firm*—Morgan, Lewis & Bockius LLP

(57) ABSTRACT

An image forming device having an adjusting mode for making settings related to image formation, using a setting unit that sets whether change to the adjusting mode is inhibited, as well as a change unit that inhibits the change to the adjusting mode when it is set to do so by the setting unit.

18 Claims, 9 Drawing Sheets

IMAGE FORMING DEVICE AND ITS CONTROL METHOD WITH ADJUSTMENT MODE

BACKGROUND OF THE INVENTION

1. Field of the Invention

The present invention relates to an image forming device having an adjusting mode for making settings related to image formation and its control method, and more particularly to an image forming device, which enhances the user security in an adjusting mode to perform a maintenance operation by a customer engineer or the like, and its control method.

2. Description of the Related Art

Conventionally, image forming devices such as copy machines and multifunctional devices are configured to switch from an ordinary mode to an adjusting mode when a prescribed key operation is made by a customer engineer or the like. In the adjusting mode, it becomes possible to access data related to the security such as not only settings related to image formation but also data about the security of a password of a machine administrator, an encryption key and the like.

It is know to provide a technology capable of efficiently finding an item of checking or changing various types of image forming settings in order to perform the setting operation easily and properly by a customer engineer or the like in an adjusting mode.

For the maintenance of settings related to the image formation of the image forming device which is used in a customer office or the like, the customer engineer activates the device in an adjusting mode and performs a prescribed operation.

Therefore, all the customer data stored in a nonvolatile memory or the like of the image forming device and information related to the security of an encryption key for encryption of the data were clearly known by the customer engineer, and it was not desirable in view of security.

Then, the present invention has been made in view of the above circumstances and provides an image forming device which enhances the security of a user in an adjusting mode, when the customer engineer or the like performs a maintenance operation, and its control method.

SUMMARY OF THE INVENTION

An aspect of the present invention provides an image forming device having an adjusting mode for making settings related to image formation, comprising: a setting unit which sets whether change to the adjusting mode is inhibited or not; and a change inhibit unit which inhibits the change to the adjusting mode when it is set by the setting unit that the change to the adjusting mode is inhibited.

A further aspect of the present invention provides an image forming device having an adjusting mode for making settings related to image formation, comprising: a data registration unit which registers data desired to be inhibited from being accessed in the adjusting mode; a data access setting unit which sets whether the access to the data registered by the data registration unit is inhibited or not; and a data access inhibit unit which inhibits the access to the data registered by the data registration unit when it is set by the data access setting unit that the access to the data registered by the data registration unit is inhibited.

A still further aspect of the present invention provides a control method of an image forming device having an adjusting mode capable of making settings related to image formation, comprising: setting by a setting unit whether the change to the adjusting mode is inhibited or not by a change inhibit unit, and inhibiting the change to the adjusting mode when it is set by the setting unit that the change to the adjusting mode is inhibited.

BRIEF DESCRIPTION OF THE DRAWINGS

Embodiments of the present invention will be described in detail based on the following figures, wherein.

DETAILED DESCRIPTION OF THE INVENTION

Embodiments of an image forming device and its control method according to the present invention will be described in detail with reference to the accompanying drawings.

Figure 1:
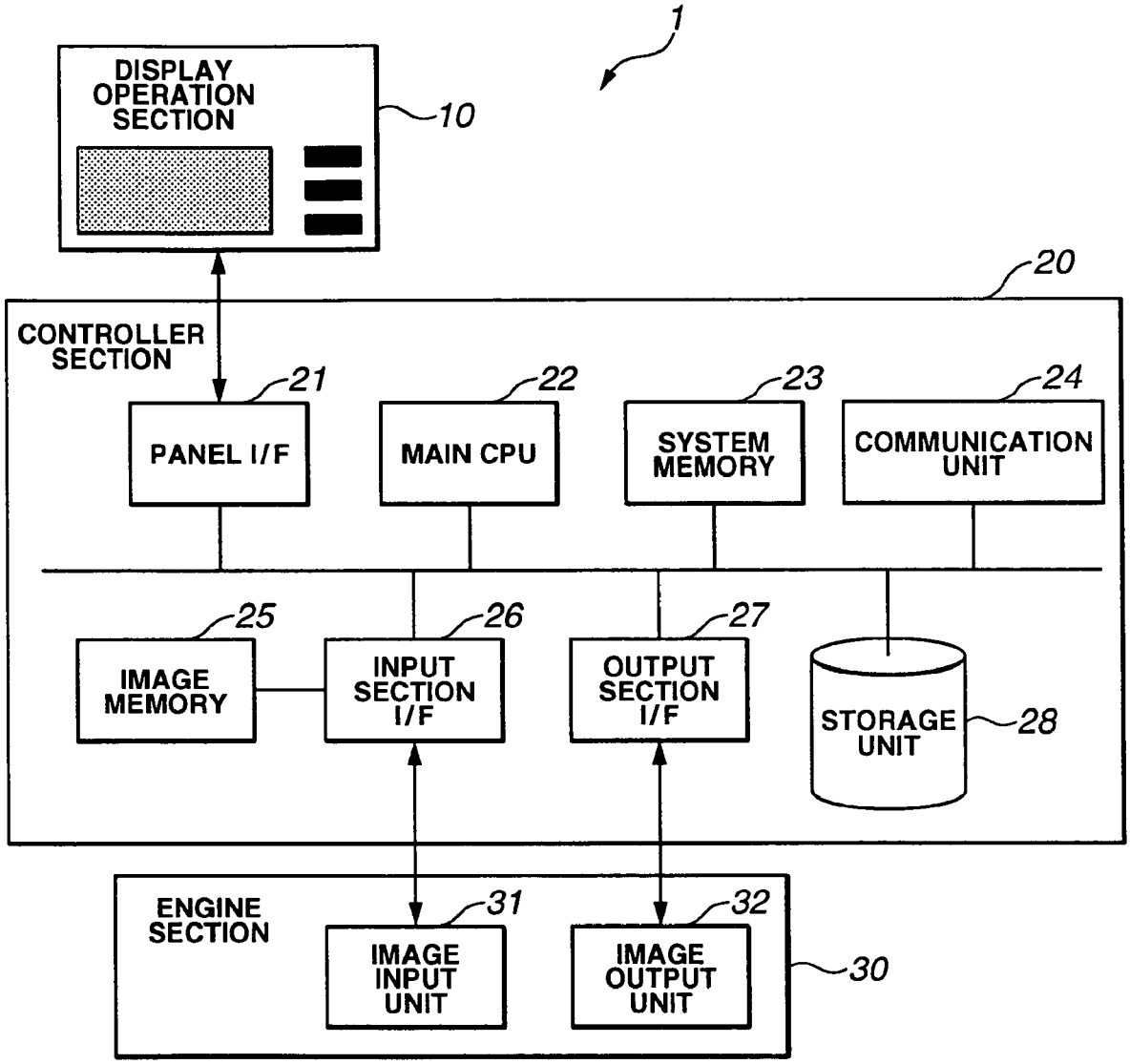
FIG. 1 is a view showing a system structure of a multifunctional device 1 to which the image forming device according to the present invention is applied.

FIG. 1 is a view showing a system structure of a multifunctional device 1 to which the image forming device according to the present invention is applied. The present invention can be applied to even a single device, a system comprised of plural devices or a system which executes processing with connection made through a network such as LAN (Local Area Network), WAN (Wide Area Network) or the like if the functions of the present invention can be performed.

In FIG. 1, the multifunctional device 1 is generally comprised of the display operation section 10 which is a user interface such as an operation panel, a controller section 20 which performs centralized control of the multifunctional device 1 and an engine section 30 which performs image input/output processing according to an instruction from the controller section 20.

The display operation section 10 is an operation panel provided on the device body as described above, and more specifically a user interface which is provided with an input device such as a touch panel and operation buttons, and a display device such as an LED (Light Emitting Diode), an LCD (Liquid Crystal Display) or the like.

The controller section 20 is comprised of a panel I/F (Interface) 21 which executes the transfer of data with the above-described display operation section 10, a main CPU (Central Processing Unit) 22 which controls and manages the operation of each section according to a program deployed in a system memory 23 or the like to be described later, the system memory 23 which is a work area for executing the program, a communication section 24 which is an interface device for communicating with another device through a telephone line or a network, an image memory 25 which temporarily stores an image, an input section I/F (Interface) 26 which executes the transfer of data such as an input image with an image input section 31 to be described later, an output section I/F (Interface) 27 which executes the transfer of data such as an output image with an image output section 32 to be described later, and a storage section 28 which holds and manages a variety of data.

The above-described storage section 28 is a storage device such as a flash ROM (Read Only Memory) or an HD (Hard Disk) which temporarily stores data about the job which was executed by the multifunctional device 1. Data which is temporarily stored in the storage section 28 includes confidential document data.

The engine section 30 is comprised of the image input section 31 such as a scanner device for reading image data which is formed on a sheet or the like and the image output section 32 such as a printer or the like for forming image data on a sheet or the lie. In this structure, the control processing according to the present invention is mainly executed by the main CPU 22.

The system configuration view of the multifunctional device 1 according to the present invention was described above. It is not shown in the figure, but the multifunctional device 1 is also provided with a power control section for controlling the supply of electricity to each component of the multifunctional device 1 as required.

Figure 2:
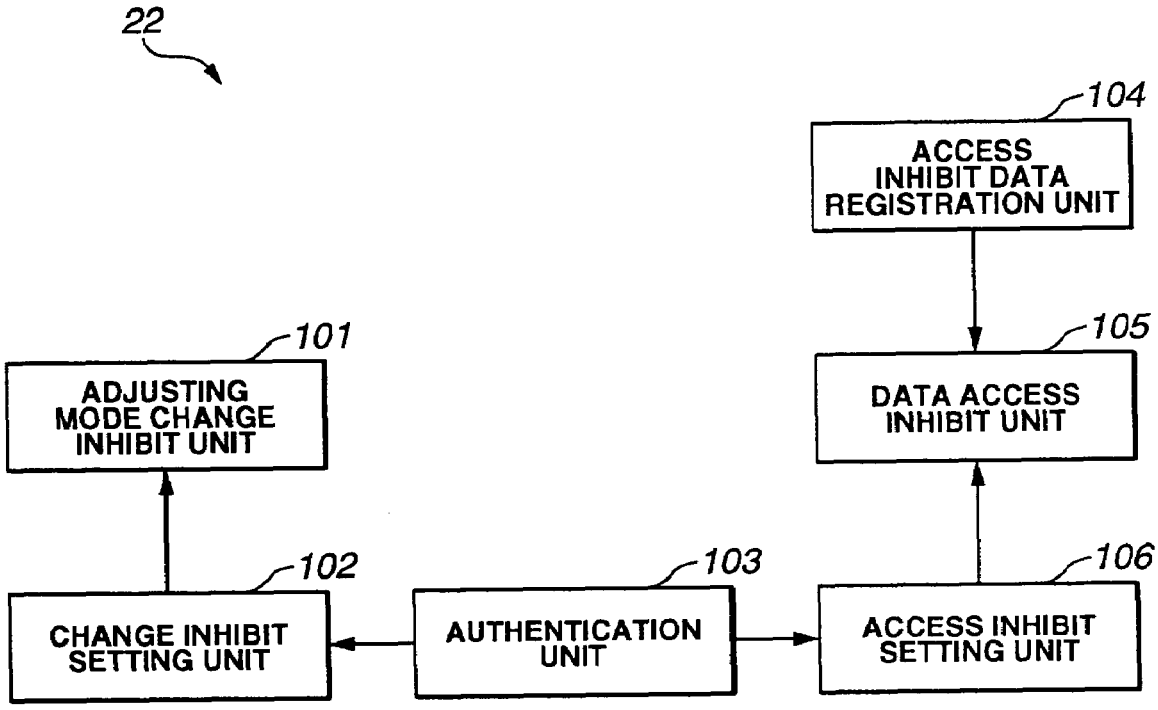
FIG. 2 is a functional block view showing a part of the functional structure of a main CPU 22 shown in FIG. 1.

FIG. 2 is a functional block view showing a part of the functional structure of the main CPU 22 shown in FIG. 1. Here, only the components relevant to the present invention will be described. It is to be understood that the same reference numerals are allotted to the same elements as those shown in FIG. 1.

In FIG. 2, the main CPU 22 works as functional sections including an adjusting mode change inhibit section 101, a change inhibit setting section 102, an authentication section 103, an access inhibit data registration section 104, a data access inhibit section 105 and an access inhibit setting section 106 as various processing functional sections.

The adjusting mode change inhibit section 101 is a processing section which inhibits a customer engineer or the like from freely changing to an adjusting mode. Specifically, where the change to the adjusting mode is inhibited by the adjusting mode change inhibit section 101, and the change to the adjusting mode cannot be made at all. It means that the adjusting mode itself is eliminated.

The change inhibit setting section 102 is a processing section for setting whether the change to the adjusting mode is inhibited or not by the above-described adjusting mode change inhibit section 101. The setting processing to determine whether the change to the adjusting mode is inhibited or not by the change inhibit setting section 102 can be conducted if a result of authentication by the authentication section 103 to be described later is normal.

The access inhibit data registration section 104 is a processing section which registers data for inhibiting the access after the change to the adjusting mode. Specifically, the data selected according to a user's instruction through the input device of the display operation section 10 is determined as access inhibit data in cooperation with the data access inhibit section 105 to be described later. In addition, data change and data deletion can also be made.

the access inhibit data registration section 104 automatically registers information about the security of an encryption key or the like used to encrypt the data in the storage section 28 into the access inhibit data. For example, where the multifunctional device 1 is provided with an optional device (such as software for encryption of data in the storage section 28) for security, security information (encryption key or the like) about the optional device is automatically registered in the access inhibit data.

The data access inhibit section 105 is a processing section which inhibits the access to data by a customer engineer or the like such that the data to be stored in the storage section 28 cannot be referenced or changed its settings freely in the adjusting mode. Specifically, the access to the data registered by the above-described access inhibit data registration section 104 is inhibited. The storage section 28 stores data on the jobs done by a user in the past and data including security information about the encryption key for encryption of the job data and inhibits the customer engineer or the like from accessing data which is required to be highly confidential.

The data access inhibit setting to be made by the data access inhibit section 105 includes broadly two methods, one for completely inhibiting the access to the storage section 28 and the other for inhibiting the access to particular data among the data to be stored in the storage section 28.

The access inhibit setting section 106 is a processing section which sets whether the access to data is inhibited by the above-described data access inhibit section 105. The setting processing to determine whether the access to data is inhibited by the access inhibit setting section 106 is executed when the result of authentication by the authentication section 103 to be described later is normal.

The authentication section 103 is a processing section which requires a password at the time of an adjusting mode change inhibit setting or a data access inhibit setting and judges whether the input password is correct or not. Specifically, where the setting processing is performed by the above-described change inhibit setting section 102 or the access inhibit setting section 106, input of a password is required, and the input password is compared with the password previously stored in the storage section 28. If they match, the processing by the change inhibit setting section 102 or the access inhibit setting section 106 is permitted.

The password previously stored in the storage section 28 is automatically registered in the access inhibit data by the access inhibit data registration section 104 such that access is inhibited in the adjusting mode.

Then, the screens displayed on the display operation section 10 shown in FIG. 1 will be described with reference to FIG. 3 and FIG. 4. Here, the screens to be displayed when the adjusting mode change inhibit setting or the data access inhibit setting is performed will be described.

Figure 3:
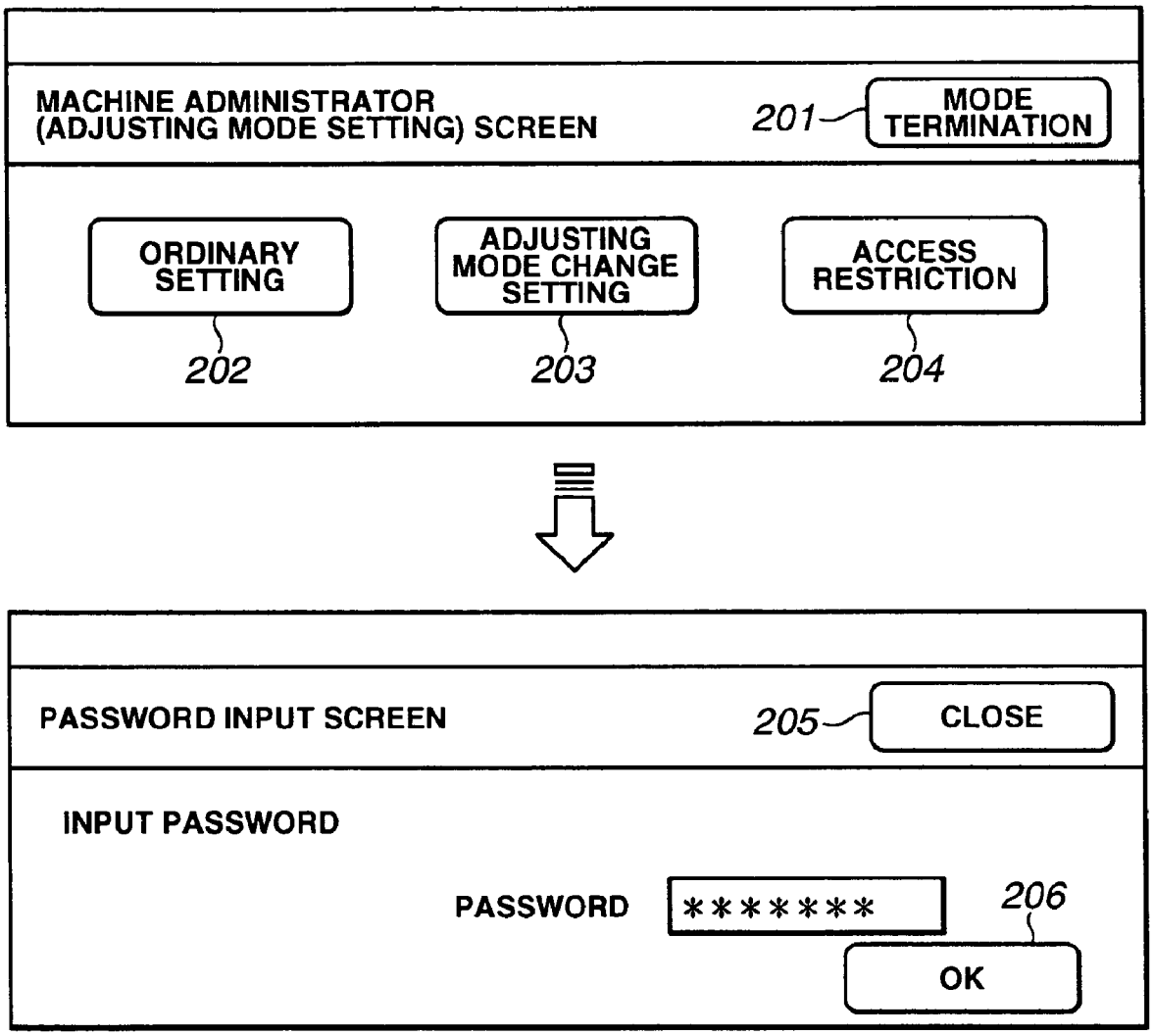
FIG. 3 is an example of the screen displayed on a display operation section 10 shown in FIG. 1.

FIG. 3 shows examples of a machine administrator (adjusting mode setting) screen and a password input screen. This password input screen is a screen which is displayed when an adjusting mode change setting button 203 or an access restriction button 204 is pushed on the machine administrator (adjusting mode setting) screen.

First, the machine administrator (adjusting mode setting) screen is a screen which is displayed when the multifunctional device 1 is changed to the machine administrator mode by a prescribed operation made by the machine administrator. This screen is provided with a mode termination button 201 which is pushed to terminate a job in the machine administrator mode, an ordinary setting button 202 which is pushed to execute general setting processing in the machine administrator mode, the adjusting mode change setting button 203 which is pushed to set whether the change to the adjusting mode is inhibited or not, and the access restriction button 204 which is pushed to set data for inhibiting the access in the adjusting mode.

Then, the password input screen is a screen which is displayed when the adjusting mode change setting button 203 or the access restriction button 204 is pushed on the machine administrator (adjusting mode setting) screen as described above. This screen is provided with a close button 205 which is pushed to cancel the password input processing and an OK button 206 which is pushed after the input of a password.

The password required on this password input screen may be different from the one which is input to change to the machine administrator mode. In such a case, even if the password to be input here was not remembered, the change to the machine administrator mode can be made, so that it is merely a matter that a data setting, by which the change to the adjusting mode is inhibited or not or the access in the adjusting mode is inhibited, cannot be made.

Figure 4:
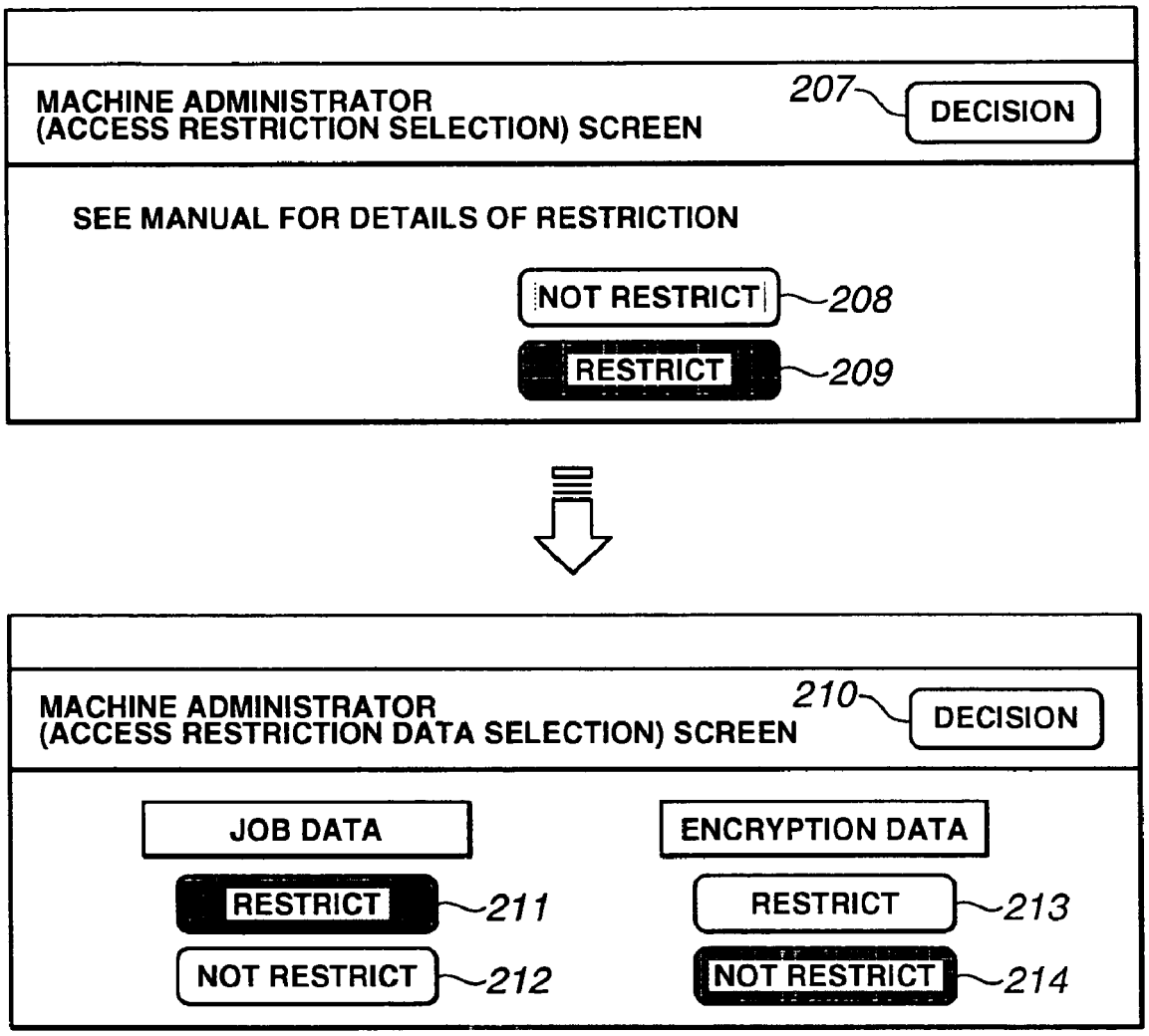
FIG. 4 is an example of the screen displayed on the display operation section 10 shown in FIG. 1.

FIG. 4 shows examples of a machine administrator (access restriction selection) screen and a machine administrator (access restriction data selection) screen.

First, the machine administrator (access restriction selection) screen is a screen which is displayed when the access restriction button 204 is pushed on the machine administrator (adjusting mode setting) screen described with reference to FIG. 3 and the password is normally authenticated on the password input screen.

The machine administrator (access restriction selection) screen is provided with a button 208 which is pushed when the access to data is not limited in the adjusting mode, a button 209 which is pushed when the access to data is limited in the adjusting mode, and a decision button 207 which is pushed when either the above-described button 208 or 209 is selected.

Subsequently, the machine administrator (access restriction data selection) screen is a screen which is displayed when the button 209 is selected on the above-described machine administrator (access restriction selection) screen and the decision button 207 is pushed.

The machine administrator (access restriction data selection) screen is provided with a button 211 which is pushed when the access to job data is limited in the adjusting mode, a button 212 which is pushed when the access to job data is not limited in the adjusting mode, a button 213 which is pushed when the access to encryption data is limited in the adjusting mode, a button 214 which is pushed when the access to encryption data is not limited in the adjusting mode, and a decision button 210 which is pushed after either of the above-described button 211 or 212 and the button 213 or 214 are selected.

As described above, according to the embodiment, it can be set such that particular data (here, job data or encryption data) is selected among the data stored in the storage section 28, and the selected data can be made not accessed in the adjusting mode. Therefore, only data required, when the customer engineer or the like executes a job, is allowed to be accessed in the adjusting mode, and the access to data, which is required to be confidential, is inhibited. Thus, the security of the user can be enhanced without disturbing the job executed by the customer engineer or the like.

It was described above that the particular data was job data or encryption data. But, it is not exclusive, and it may be in a file unit, a directory unit or a drive unit.

Figure 5:
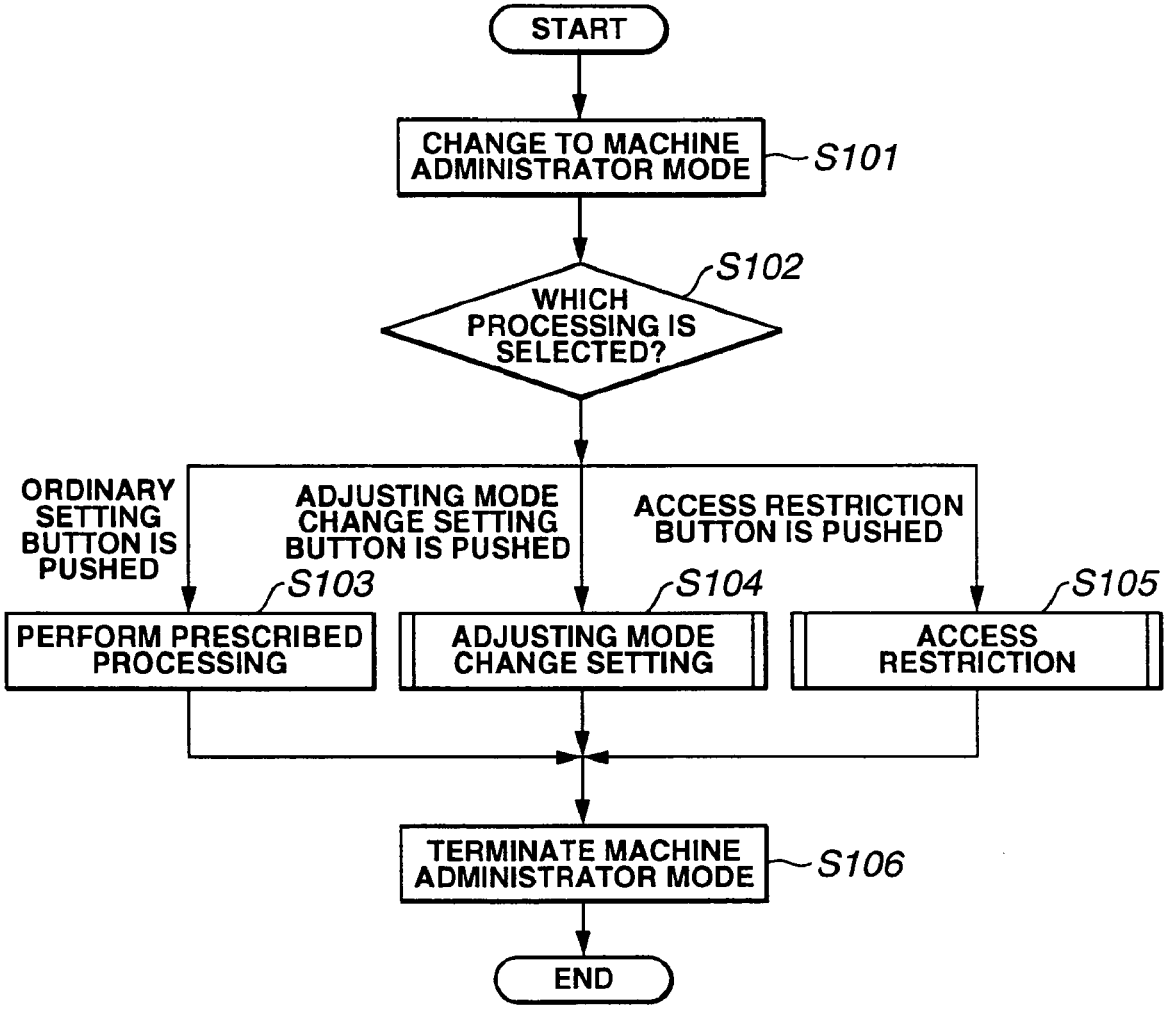
FIG. 5 is a flow chart illustrating an operation of control processing of the multifunctional device 1 shown in FIG. 1.
Figure 6:
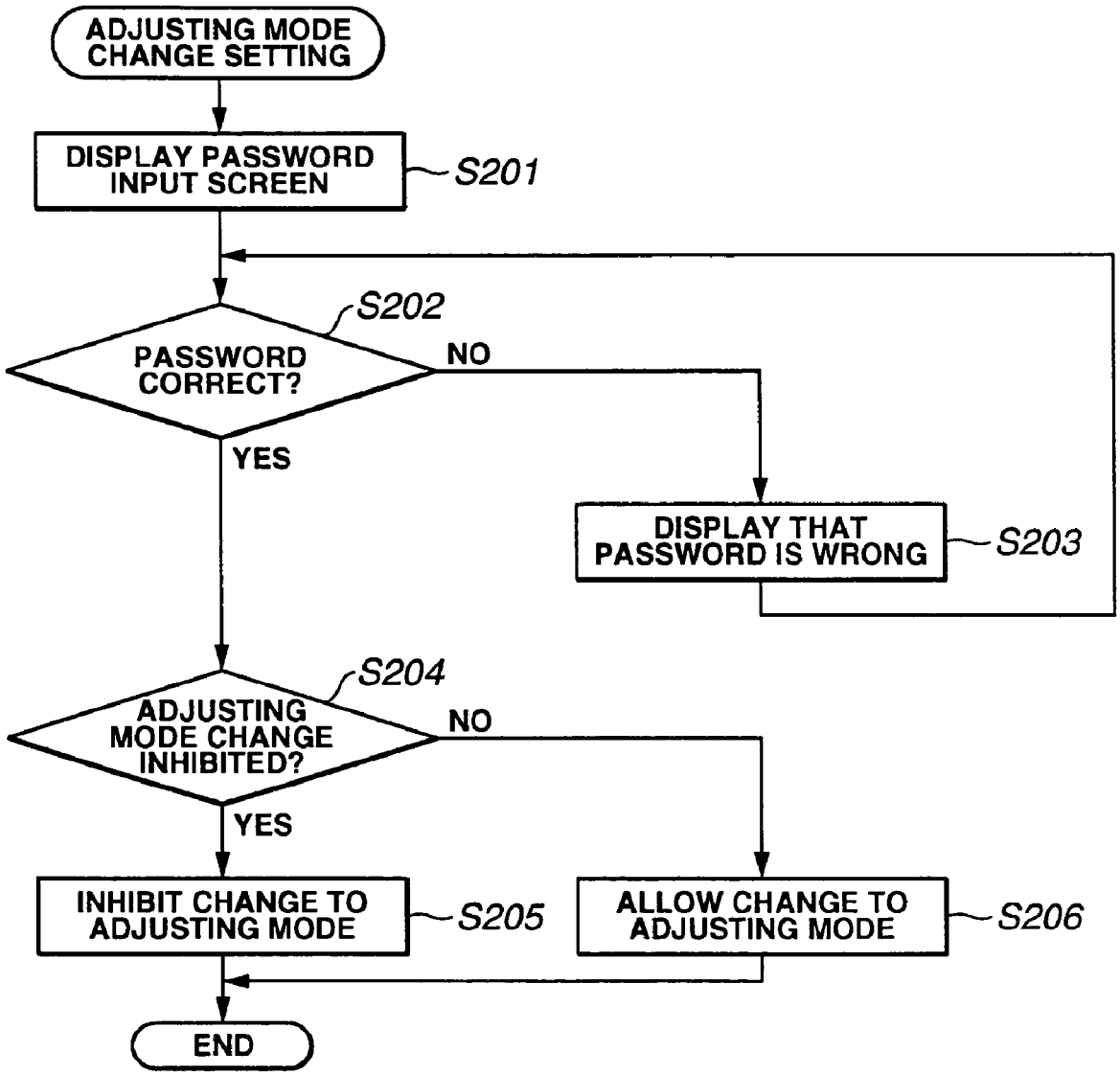
FIG. 6 is a flow chart illustrating an operation of adjusting mode change setting processing shown in FIG. 5.
Figure 7:
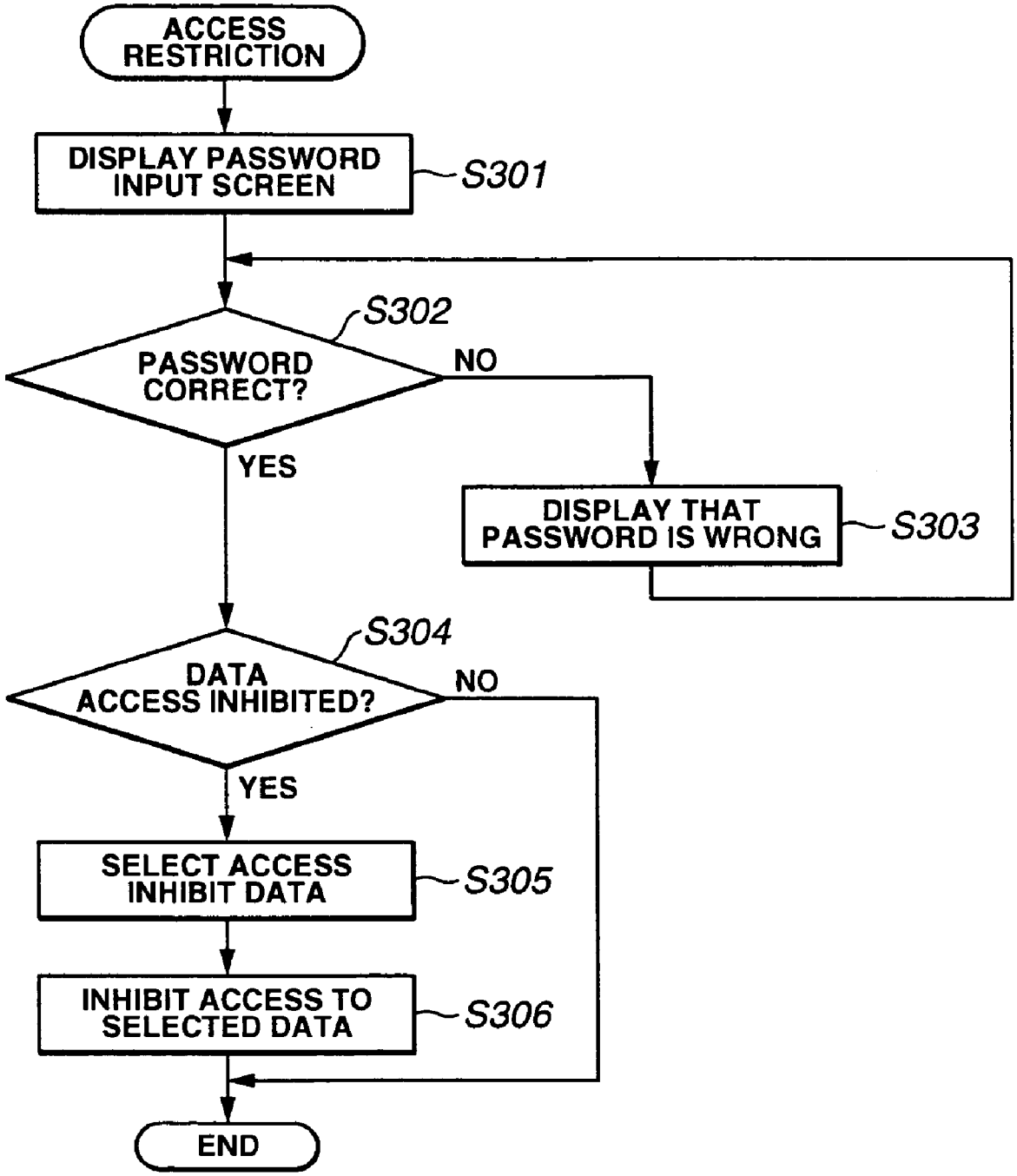
FIG. 7 is a flow chart illustrating an operation of access limitation processing shown in FIG. 5.

FIG. 5 to FIG. 7 are flow charts illustrating the operation of control processing by the multifunctional device 1 shown in FIG. 1. Here, the operation by the multifunctional device 1 to perform an adjusting mode change inhibit setting or a data access inhibit setting will be described.

In FIG. 5, this control processing is started when the machine administrator executes a prescribed operation and the multifunctional device 1 is changed to a machine administrator mode (step S101).

When this control processing is started, the multifunctional device 1 displays the machine administrator (adjusting mode setting) screen described with reference to FIG. 3 on the display operation section 10 and waits for input of a user instruction (step S102). In other words, it is in a standby state until any of the ordinary setting button 202, the adjusting mode change setting button 203 and the access restriction button 204 is pushed by the user on the machine administrator (adjusting mode setting) screen.

Here, if the ordinary setting button 202 is pushed (the normal setting button is pushed in step S102), general setting processing is performed in the machine administrator mode (step S103), the machine administrator mode is terminated (step S106), and this control processing is terminated.

If the adjusting mode change setting button 203 is pushed (the adjusting mode change setting button is pushed in step S102), the adjusting mode change setting processing is performed (step S104) to be described in detail later, the machine administrator mode is terminated (step S106), and this control processing is terminated.

If the access restriction button 204 is pushed (the access restriction button is pushed in step S102), the access limitation processing is performed (step S105) to be described in detail later, the machine administrator mode is terminated (step S106), and this control processing is terminated.

Here, the operation of the adjusting mode change setting processing in the above-described step S104 will be described with reference to FIG. 6.

In FIG. 6, when this adjusting mode change setting processing is started, the multifunctional device 1 displays the password input screen, which was described with reference to FIG. 3, on the display operation section 10 and waits for input of a user instruction (step S201). In other words, the multifunctional device 1 waits until the user inputs a password on the password input screen.

Here, when the password is input, the input password is compared with the password previously stored in the storage section 28 to judge if they match (step S202).

If the input password is wrong (NO in step S202), it is indicated on the display operation section 10 that the password is wrong (step S203), and the multifunctional device 1 waits again the input of a password, but if the input password is correct (YES in step S202), it is selected whether the change to the adjusting mode is inhibited or not (step S204).

If the user desires to inhibit the adjusting mode change by this selection processing (YES in step S204), it is set to inhibit the change to the adjusting mode (step S205) and the adjusting mode change setting processing is terminated. But, if the user does not desire to inhibit the adjusting mode change (NO in step S204), it is set to allow the change to the adjusting mode (step S206), and the adjusting mode change setting processing is terminated.

Subsequently, the operation of access limitation processing in the above described step S105 will be described with reference to FIG. 7.

In FIG. 7, when the access limitation processing is started, the multifunctional device 1 displays the password input screen, which was described with reference to FIG. 3, on the display operation section 10 and waits for input of a user instruction (step S301). In other words, it waits until the user inputs a password on the password input screen.

Here, when the password is input, the input password is compared with the password previously stored in the storage section 28 to judge if they match (step S302).

If the input password is wrong (NO in step S302), it is indicated on the display operation section 10 that the password is wrong (step S303), and the multifunctional device 1 waits again the input of a password, but if the input password is correct (YES in step S302), it is selected whether access inhibit data is set or not (step S304). In other words, the machine administrator (access restriction selection) screen described with reference to FIG. 4 is displayed, and input of a user instruction is waited for.

If the user does not desire the access restriction in the adjusting mode by this selection processing (NO in step S304), the access limitation processing is terminated. But, if the user desires to set data to which access is restricted (YES in step S304), access inhibit data is selected on the machine administrator (access restriction data selection) screen which was described with reference to FIG. 4 (step S305), the decision button 210 is pushed to set the selected data to the access inhibit (step S306), and this access limitation processing is terminated.

Then, the screen to be displayed on the display operation section 10 shown in FIG. 1 will be described with reference to FIG. 8A and FIG. 8B. Here, the screen to be displayed when the customer engineer or the like makes a job in the adjusting mode will be described.

Figure 8A:
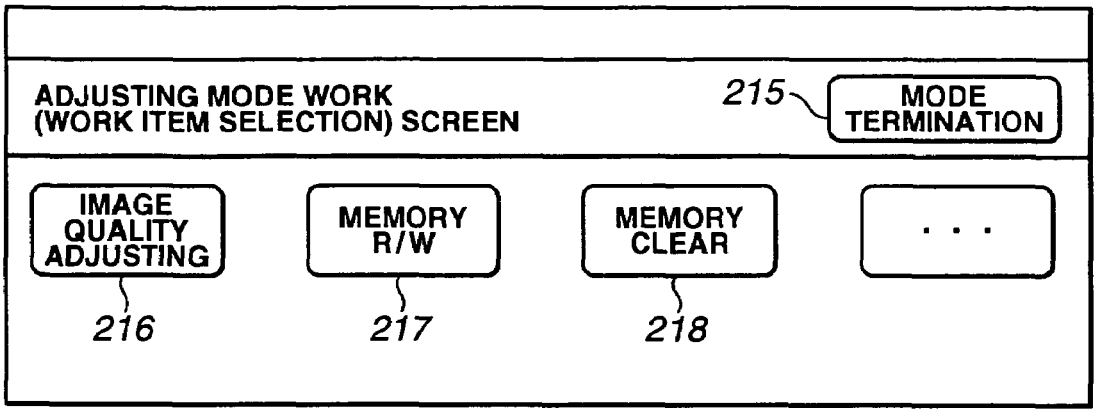
FIG. 8A and FIG. 8B show an example of the screen displayed on the display operation section 10 shown in FIG. 1.
Figure 8B:
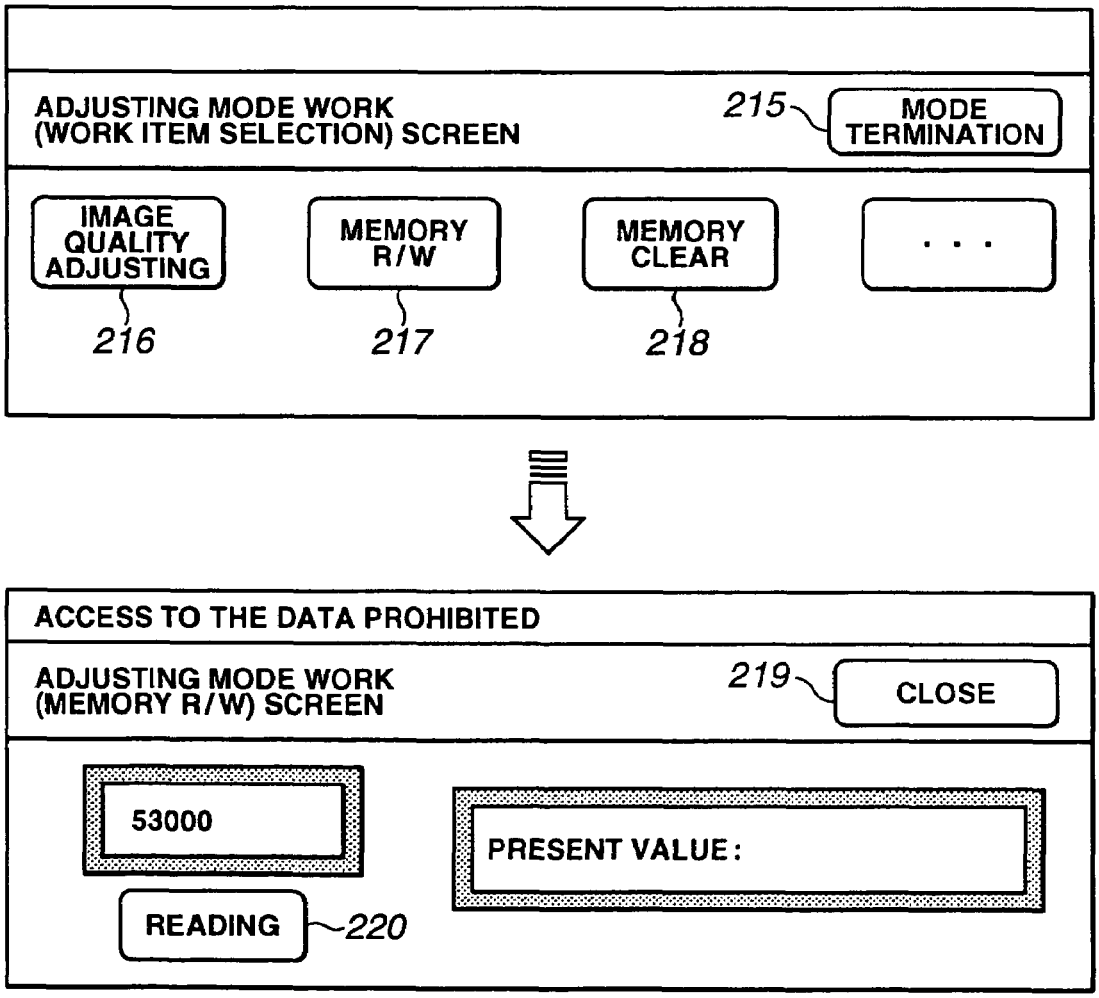

FIG. 8A and FIG. 8B show examples of the adjusting mode work screen, and adjusting mode work screens (FIG. 8A) and (FIG. 8B) to which access is previously restricted will be described. Specifically, FIG. 8A is a screen which is displayed when access restriction has been made such that the customer engineer or the like cannot access the storage section 28 at all, and FIG. 8B is a screen which is displayed when the access by the customer engineer or the like to the storage section 28 or the like is allowed but accessible data is limited.

The adjusting mode work screen is a screen to be displayed when the machine administrator performs a prescribed operation, and the multifunctional device 1 is changed to the adjusting mode.

First, FIG. 8A shows an adjusting mode work (work item selection) screen, which has a mode termination button 215 which is pushed to terminate the job in the adjusting mode, an image quality adjusting button 216 which is pushed to adjust the image quality, a memory R/W button 217 which is pushed to perform reading/writing of data to be stored in the storage section 28 or the like, and a memory clear button 218 which is pushed to initialize data to be stored in the storage section 28 or the like. But, the memory R/W button 217 is controlled to an inactive state such that it cannot be pushed. In other words, the access is previously restricted by the machine administrator or the like such that the customer engineer or the like cannot access the storage section 28 or the like at all.

Meanwhile, FIG. 8B shows the same screen as the adjusting mode work (work item selection) screen described with reference to FIG. 8A and an adjusting mode work (memory R/W) screen to be displayed when the memory R/W button 217 is pushed on the same screen.

FIG. 8A shows that the memory R/W button 217 is made inactive, such that the access to the storage section 28 cannot be made at all, but FIG. 8B shows that the memory access R/W button 217 is made active such that the access to the storage section 28 or the like by the customer engineer or the like is permitted, but access to data is restricted on the adjusting mode work (memory R/W) screen.

Figure 9:
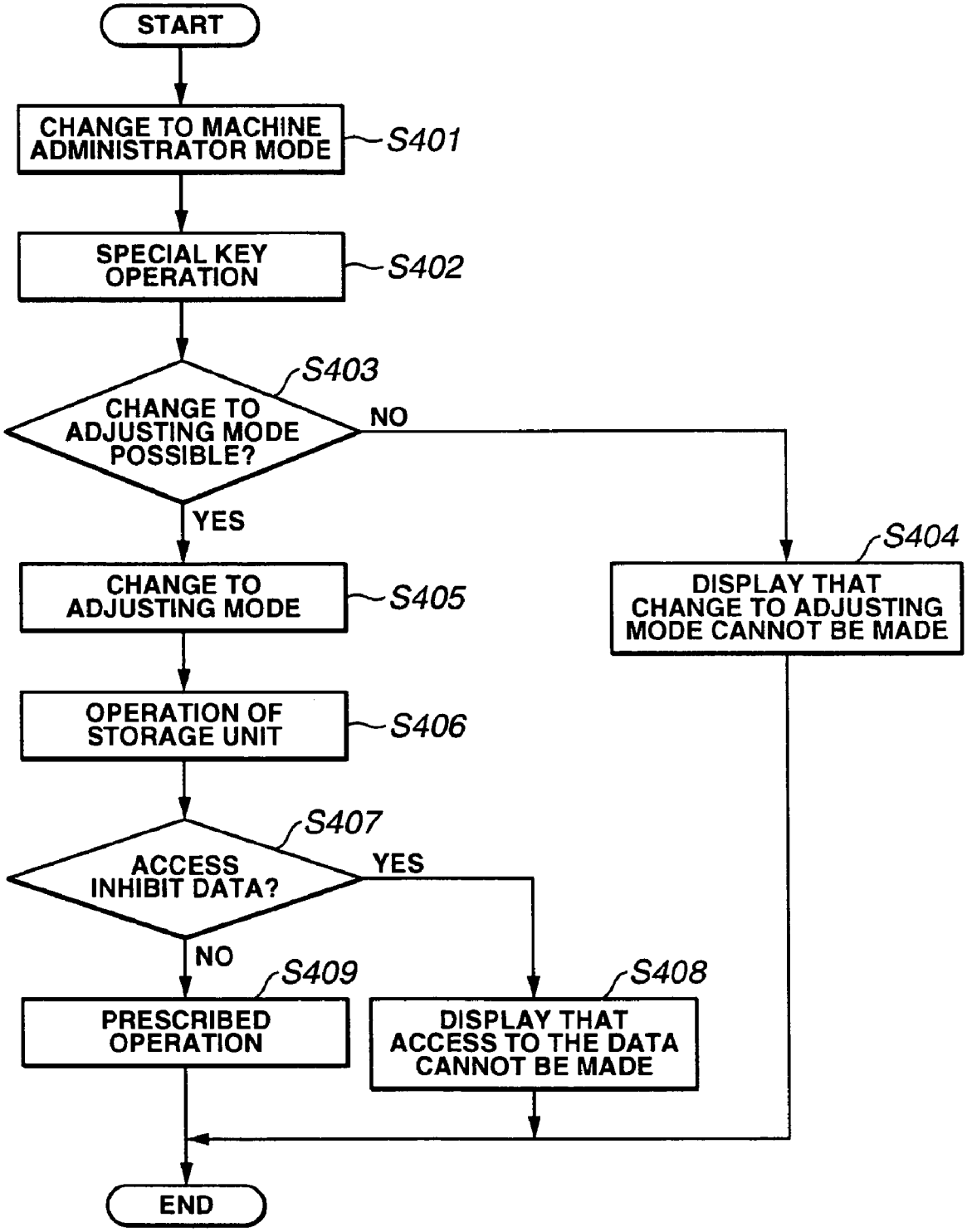
FIG. 9 is a flow chart illustrating an operation of control processing of the multifunctional device 1 shown in FIG. 1.

FIG. 9 is a flow chart illustrating the operation of control processing by the multifunctional device 1 shown in FIG. 1. Here, the operation of the multifunctional device 1 when the customer engineer or the like performs a maintenance operation in the adjusting mode will be described.

In FIG. 9, this control processing is started when the machine administrator performs a prescribed operation to change the multifunctional device 1 to the machine administrator mode (step S401).

When the control processing is started, a special key is input by the machine administrator (step S402). Thus, the processing to change the multifunctional device 1 to the adjusting mode is performed. It may be configured to change to the adjusting mode by inputting a password or to change to the adjusting mode by inputting a special key.

When the special key is input by the machine administrator, the multifunctional device 1 judges whether the change to the adjusting mode is inhibited or not (step S403). Specifically, it is judged whether the change inhibit setting by the adjusting mode change inhibit section 101 is made by the change inhibit setting section 102.

Here, if the adjusting mode change inhibit is set (NO in step S403), it is displayed on the screen of the display operation section 10 that the change to the adjusting mode cannot be made (step S404), and this control processing is terminated, but if the adjusting mode change inhibit is not set (YES in step S403), the multifunctional device 1 is changed to the adjusting mode (step S405).

When changed to the adjusting mode, the customer engineer or the like tries to access the data to be stored in the storage section 28 in order to perform the maintenance operation (step S406).

At the time of the data access processing by the customer engineer or the like, the multifunctional device 1 judges whether the stored data is access inhibit data or not (step S407). Specifically, it is judged whether the access inhibit setting by the data access inhibit section 105 has been made by the access inhibit setting section 106.

Here, if data to which the customer engineer or the like desires to access is access inhibit data (YES in step S407), it is displayed on the screen that the access to that data is not permitted (step S408), then this control processing is terminated. But, if the access inhibit is not set (NO in step S407), the customer engineer or the like performs a prescribed processing by the multifunctional device 1 (step S409), and this control processing is terminated.

As described above, it can be set whether the change to the adjusting mode is inhibited or not. Therefore, if the change to the adjusting mode is inhibited by the above setting, the change to the adjusting mode cannot be made freely by the customer engineer or the like. Thus, the security, which was conventionally broken by accessing to the customer data in the adjusting mode, can be secured.

It can also be configured such that data to which access is desired to be inhibited is selected among the data stored in the storage section 28 and the selected data can be set, so that the access to it cannot be made in the adjusting mode. Therefore, only data required in order for conduction of a job by the customer engineer or the like can be made accessible in the adjusting mode, and data required to be confidential is set not to be accessed. Thus, the job to be performed by the customer engineer or the like is not disturbed, and the security of the user can be enhanced.

It was described in the above-embodiment that the image forming device according to the present invention was applied to the multifunctional device 1. It may be configured that the control method of the image forming device is performed by the control program installed in the multifunctional device 1.

The image forming device according to the present invention is not limited to the multifunctional device but can also be applied to general image forming devices such as printers, facsimiles, copy machines and the like.

In addition, the present invention is not limited to the examples described above and shown in the drawings, and various modifications may be made without deviating from the spirit and scope of the invention. For example, a customer engineer mode applying the present invention may be disposed newly.

The image forming device and its control method of the present invention can be applied to general image forming devices having an adjusting mode and particularly used effectively in offices and the like having an image forming device which is often subjected to a maintenance work by the customer engineer or the like.

The entire disclosure of Japanese Patent Application No. 2004-278108 filed on Sep. 24, 2004 including specification, claims, drawings and abstract is incorporated herein by reference in its entirety.

What is claimed is:

1. An image forming device having an adjusting mode for making settings related to image formation, comprising:

a setting unit which sets whether change to the adjusting mode is inhibited or not; and a change inhibit unit which inhibits the change to the adjusting mode when it is set by the setting unit that the change to the adjusting mode is inhibited.

2. The image forming device according to claim 1, further comprising an authentication unit which performs authentication processing at the time of setting by the setting unit whether the change to the adjusting mode is inhibited or not, wherein:

the setting unit permits to set whether the change to the adjusting mode is inhibited or not when the result of authentication made by the authentication unit is normal.

3. The image forming device according to claim 2, further comprising a password memory which stores a password, wherein:

the authentication unit judges that the authenticated result is normal when a password input through an operation device matches the password being stored in the password memory.

4. An image forming device having an adjusting mode for making settings related to image formation, comprising:

a data registration unit which registers data inhibited from being accessed in the adjusting mode;

a data access setting unit which sets whether the access to the data registered by the data registration unit is inhibited or not; and a data access inhibit unit which inhibits the access to the data registered by the data registration unit when it is set by the data access setting unit that the access to the data registered by the data registration unit is inhibited.

5. The image forming device according to claim 4, further comprising an authentication unit which performs authentication processing when setting by the data access setting unit whether the access to data to be registered by the data registration unit is inhibited or not, wherein:

the setting unit allows making a setting whether the access to the data to be registered by the data registration unit is inhibited or not when the result of authentication made by the authentication unit is normal.

6. The image forming device according to claim 5, further comprising a password memory which stores a password, wherein:

the authentication unit judges that the authenticated result is normal when the password input through an operation device matches the password being stored in the password memory.

7. The image forming device according to claim 4, wherein:

the data registration unit automatically registers the password stored in a password memory, and the data access inhibit unit inhibits the access to the data registered by the data registration unit.

8. The image forming device according to claim 4, wherein:

the data registration unit automatically registers an encryption key which is used to encrypt data, and the data access inhibit unit inhibits the access to the encryption key registered by the data registration unit.

9. A control method of an image forming device having an adjusting mode capable of making settings related to image formation, comprising:

setting by a setting unit whether the change to the adjusting mode is inhibited or not by a change inhibit unit, and inhibiting the change to the adjusting mode when it is set by the setting unit that the change to the adjusting mode is inhibited.

10. An image forming device having an adjusting mode for making settings related to image formation, comprising:

an access inhibited data setting unit which sets data inhibited from being accessed in the adjusting mode; and a data access inhibit unit which inhibits the access to the data when it is set by the access inhibited data setting unit that the access to the data is inhibited.

11. An image forming device having an adjusting mode for making settings related to image formation, comprising:

a setting means for setting whether change to the adjusting mode is inhibited or not; and a change inhibit means for inhibiting the change to the adjusting mode when it is set by the setting means that the change to the adjusting mode is inhibited.

12. The image forming device according to claim 11, further comprising an authentication means for performing authentication processing at the time of setting by the setting means whether the change to the adjusting mode is inhibited or not, wherein:

the setting means permits to set whether the change to the adjusting mode is inhibited or not when the result of authentication made by the authentication means is normal.

13. The image forming device according to claim 12, further comprising a password memory for storing a password, wherein:

the authentication means judges that the authenticated result is normal when a password input through an operation device matches the password stored in the password memory.

14. An image forming device having an adjusting mode for making settings related to image formation, comprising:

a data registration means for registering data inhibited from being accessed in the adjusting mode;

a data access setting means for setting whether the access to the data registered by the data registration means is inhibited or not; and a data access inhibit means for inhibiting the access to the data registered by the data registration means when it is set by the data access setting means that the access to the data registered by the data registration means is inhibited.

15. The image forming device according to claim 14, further comprising an authentication means for performing authentication processing when setting by the data access setting means whether the access to data to be registered by the data registration means is inhibited or not, wherein:

the setting means allows making a setting whether the access to the data to be registered by the data registration means is inhibited or not when the result of authentication made by the authentication means is normal.

16. The image forming device according to claim 15, further comprising a password memory for storing a password, wherein:

the authentication means judges that the authenticated result is normal when the password input through an operation device matches the password stored in the password memory.

17. The image forming device according to claim 14, wherein:

the data registration means automatically registers the password stored in a password memory, and the data access inhibit means inhibits the access to the data registered by the data registration means.

18. The image forming device according to claim 14, wherein:

the data registration means automatically registers an encryption key which is used to encrypt data, and the data access inhibit means inhibits the access to the encryption key registered by the data registration means.

* * * * *